US006019577A

United States Patent [19]

Dye

[11] Patent Number: 6,019,577

[45] Date of Patent: Feb. 1, 2000

[54] CEILING FAN WITH LIGHT ASSEMBLY

[76] Inventor: David L. Dye, 3541 High Countryside Dr., Grapevine, Tex. 76051

[21] Appl. No.: 08/987,725

[22] Filed: Dec. 9, 1997

[51] Int. Cl.[7] ..... F04D 29/70

[52] U.S. Cl. ..... 416/5; 362/147

[58] Field of Search ..... 416/5, 244 R; 362/96, 147, 404

[56] References Cited

U.S. PATENT DOCUMENTS

| | | | |
|---|---|---|---|
| 332,821 | 12/1885 | Murray . | |
| D. 344,794 | 3/1994 | Galler | 416/5 |
| D. 376,008 | 11/1996 | Chan . | |
| 1,940,318 | 12/1933 | Morse . | |
| 2,123,071 | 7/1938 | Ballman . | |
| 2,201,153 | 5/1940 | Brown . | |
| 4,064,427 | 12/1977 | Hansen et al. . | |
| 4,382,400 | 5/1983 | Stutzman | 416/5 |
| 5,195,870 | 3/1993 | Liu | 416/5 |
| 5,292,228 | 3/1994 | Dye | 416/5 |
| 5,440,459 | 8/1995 | Chan . | |
| 5,528,469 | 6/1996 | Todd, Jr. . | |
| 5,655,877 | 8/1997 | Yu . | |

*Primary Examiner*—Edward K. Look
*Assistant Examiner*—Richard Woo
*Attorney, Agent, or Firm*—Haynes and Boone, L.L.P.

[57] ABSTRACT

A ceiling fan with a light assembly that illuminates a room without producing a strobe effect while the blades are rotating. The ceiling fan includes a motor assembly for producing rotational motion. The motor is contained in a housing with an opening in a lower portion of the housing. A plurality of blades, rotating within a plane of rotation and extending radially outward from beneath the housing are secured to the motor opening in the lower portion of the housing. A light source is coupled to the housing along a circumference. A cover is also coupled to the housing, wherein the cover partially surrounds the light source to prevent downward illumination from the light source toward the plurality of blades.

28 Claims, 3 Drawing Sheets

CEILING FAN WITH LIGHT ASSEMBLY

TECHNICAL FIELD

The invention relates generally to an air circulating apparatus and, more particularly, to a ceiling fan with a light assembly.

BACKGROUND OF THE INVENTION

Ceiling fans are typically installed by removing an existing light fixture and replacing the light fixture with a ceiling fan. Removal of the light fixture reduces the light available in a room. In order to overcome the reduction in light, ceilings fans used to replace light fixtures typically have a light assembly attached thereto, which utilize incandescent or fluorescent light sources.

Known methods of attaching the light assembly to the ceiling fan result in a strobe like effect due to the projection path of the illuminating light and the placement of the light assembly in relation to the circulating fan blades of the ceiling fan. According to know methods, the light source is fixed to the ceiling fan at a location between the fan blades and the floor of the room. The illumination produced by the light assembly radiates in all directions, including upwards. Thus, as the illumination path is intersected by the circulating fan blades, a strobe effect is produced on the ceiling.

Other known methods place the light assembly between the circulation fan blades of the ceiling fan and the ceiling of the room. As discussed above, the illumination generated by the light source radiates in all directions, including downward. Due to the relational placement of the light assembly and the circulating fan blades of the ceiling fan, a strobe effect is created on the floor of the room, as the circulating fan blades intersect the illumination path. Thus, in known methods of attaching light assemblies to ceiling fans, the circulation of the fan blades causes a strobe effect on the floor or the ceiling depending on the location of the light source relative to the fan blades.

Other known methods include, as set forth in U.S. Pat. No. 5,028,206, the use of neon tubes attached to the perimeter of each of the fan blades. However, the neon tubes rotate with the blades resulting in erratic illumination and light pattern.

Therefore, what is needed is a ceiling fan with a light assembly that sufficiently illuminates a room without producing a strobe effect while the fan blades are rotating.

SUMMARY OF THE INVENTION

The foregoing problems are solved and a technical advance is achieved by a ceiling fan with a light assembly that illuminates a room without producing a strobe effect while the fan blades are rotating. To this end, a ceiling fan for circulating air within a room includes a housing for containing a motor assembly which produces rotational motion. A plurality of blades are attached to the motor assembly and extend radially outward from beneath the housing. The blades rotate within a plane of rotation to circulate air. A light source is disposed about the exterior of the housing for illuminating the room. A means for preventing direct illumination from the light source toward the plane of rotation of the plurality of blades is coupled to the housing and disposed between the light source and the plurality of blades. In a preferred embodiment, the preventing means is a plurality of covers disposed adjacent the light source. In another embodiment, the preventing means is a cover ring in which the light source is contained.

A principal advantage of the present invention is that the ceiling fan can circulate air and illuminate a room without producing a strobe effect.

Another advantage of the present invention is that the housing of the ceiling fan can be illuminated without producing a strobe effect.

Another advantage of the present invention is that the aesthetic appeal of the ceiling fan is enhanced due to the arrangement of the covers on the housing of the ceiling fan.

Yet another advantage of the present invention is that it reduces the profile of the ceiling fan by eliminating the need for light kits mounted underneath the ceiling fan, thereby making it more suitable for use in rooms with a reduced ceiling height.

Yet another advantage of the present invention is that aesthetic lighting effects can be produced on the ceiling fan housing without producing a strobe effect.

DETAIL DESCRIPTION

Figure 1:
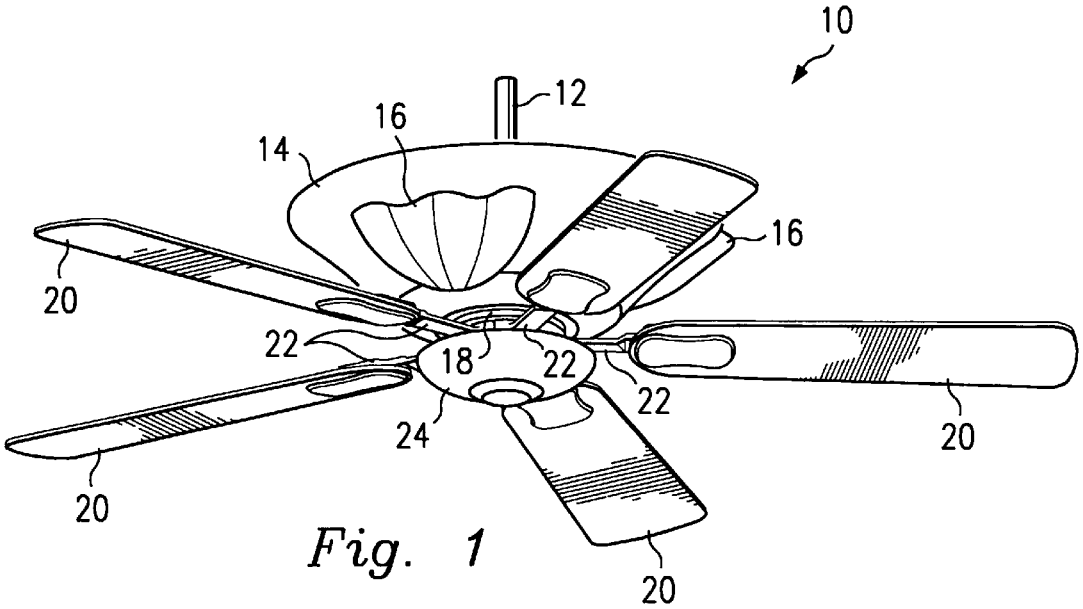
FIG. 1 is perspective view of a ceiling fan and light assembly in accordance with an embodiment of the present invention.
Figure 2:
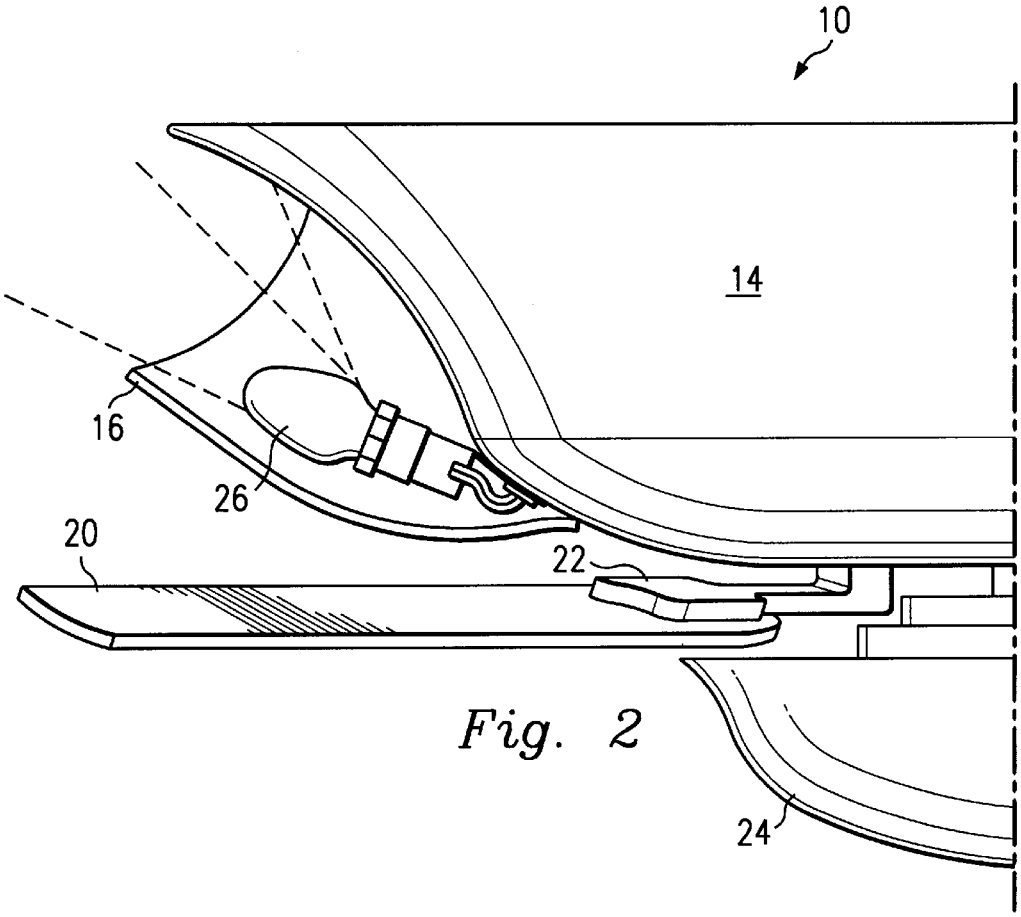
FIG. 2 is a cut-away side view of the assembly of FIG. 1.

Referring to FIG. 1 and FIG. 2, a ceiling fan assembly, generally designated 10, is shown having a support stem 12, a bowl shaped housing 14, a plurality of covers 16, a motor 18, a plurality of fan blades 20, a plurality of blade supports 22, a switch cover 24, and an incandescent light source having a plurality of bulbs 26. The assembly 10 is suspended from a ceiling (not shown) using the stem 12. The stem 12 terminates at the motor 18 which is secured to the interior of the housing 14. The housing 14 is shown having a bowl shape, for illustrative purposes only, such that the upper end of the housing 14 has a larger circumference than the lower end of the housing 14. Although the housing 14 is shown having the bowl shape, other geometric designs are contemplated and can be utilized that provide a surface for illumination.

The covers 16 are scalloped-shaped and attached to the perimeter of the housing 14 evenly about the housing 14 according to the locations of the incandescent light source. For example, in one embodiment the incandescent light source can include three bulbs 26. The central axis of each of the bulbs 26 will be separated from the central axis of each of the other bulbs 26 by 120 degrees rotation about the circumference of the housing 14. Accordingly, three of the covers 16 are used and secured to the housing 14, one disposed adjacent to and beneath each of the bulbs 26.

The motor 18 extends through an opening at the lower end of the housing 14. The blade supports 22 are attached to the motor 18 at predetermined locations depending on the desired number of the fan blades 20. Although five of the fan blades 20 are shown, any number of fan blades can be used as dictated by convention. The fan blades 20 are secured to the blade supports 22. Thus, rotational motion produced by the motor 18 will produce air circulation through rotational motion of the fan blades 20 in a conventional manner.

In order to control the speed of rotation of the fan blades 20, the motor 18 has a control switch (not shown) which can be controlled by a pull string (not shown) to allow easy access by a user. Similarly, the incandescent light source can include an on/off switch (not shown) and a pull string (not shown) can be suspended from the on/off switch to allow easy access by the user. To enhance the aesthetic appearance of the ceiling fan 10, as well as for safety reasons, the switch cover 24 is attached to an end of the motor 18. The pull strings extend through appropriate openings (not shown) in the switch cover 24.

In operation, light from the bulbs 26 of the incandescent light source radiates equally in all directions. Accordingly, light travels upwards toward the housing 14 and downward towards the covers 16. The covers 16 block the light from the bulbs 26 traveling downward to prevent the light from traveling through the rotational plane of the fan blades 20 while allowing upward projection toward the housing 14. Accordingly, the covers 16 eliminate the strobe effect produced by direct light from the bulbs 26. As the light radiating from the bulbs 26 comes into contact with the housing 14, the housing 14 disperses the light to prevent direct downward reflection, thereby further preventing light from intersecting the rotational plane of the fan blades 20. Thus, the housing 14 causes dispersion of the light throughout the room while further eliminating the strobe effects. Furthermore, the housing 14 can be coated with an appropriate type of material to enhance dispersion of the light, as well as with aesthetic sculpting and design features to create pleasing lighting effects on the housing 14, also without strobe effects observed in known ceiling fans.

FIG. 2 shows one of the covers 16, in cut-away, attached to the housing 14. The light radiating from the shown bulb 26 travels toward the housing 14 and the ceiling of the room. The light from the bulb 26 can not penetrate and travel downward toward the plane of rotation of the fan blades 20 because of the cover 16. Consequently, the room and housing 14 are illuminated while the strobe effect is eliminated.

Figure 3:
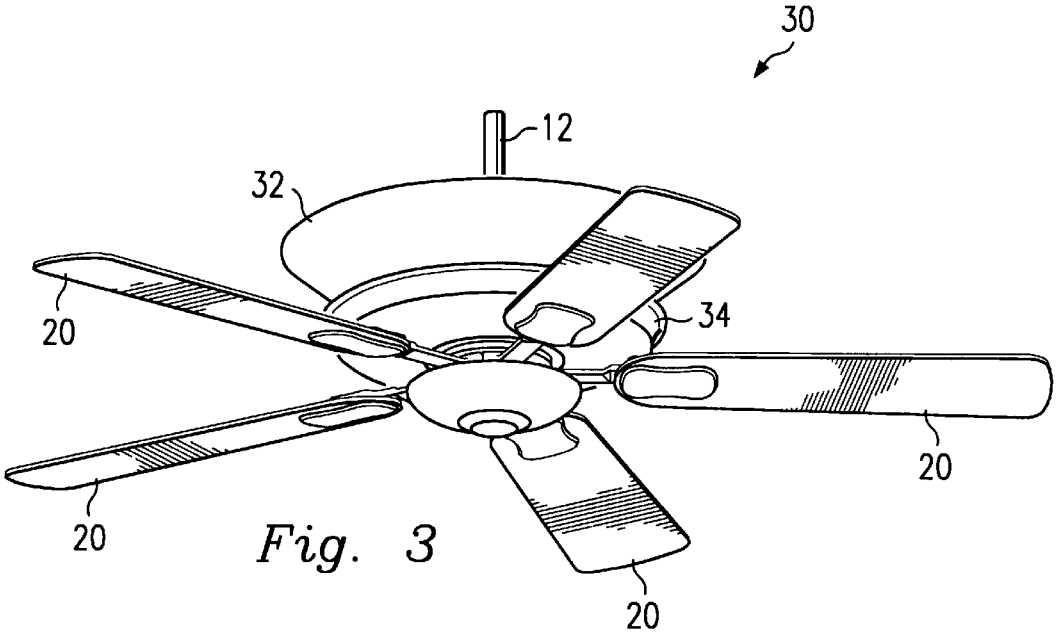
FIG. 3 is a perspective view of a ceiling fan and light assembly in accordance with another embodiment of the present invention.
Figure 4:
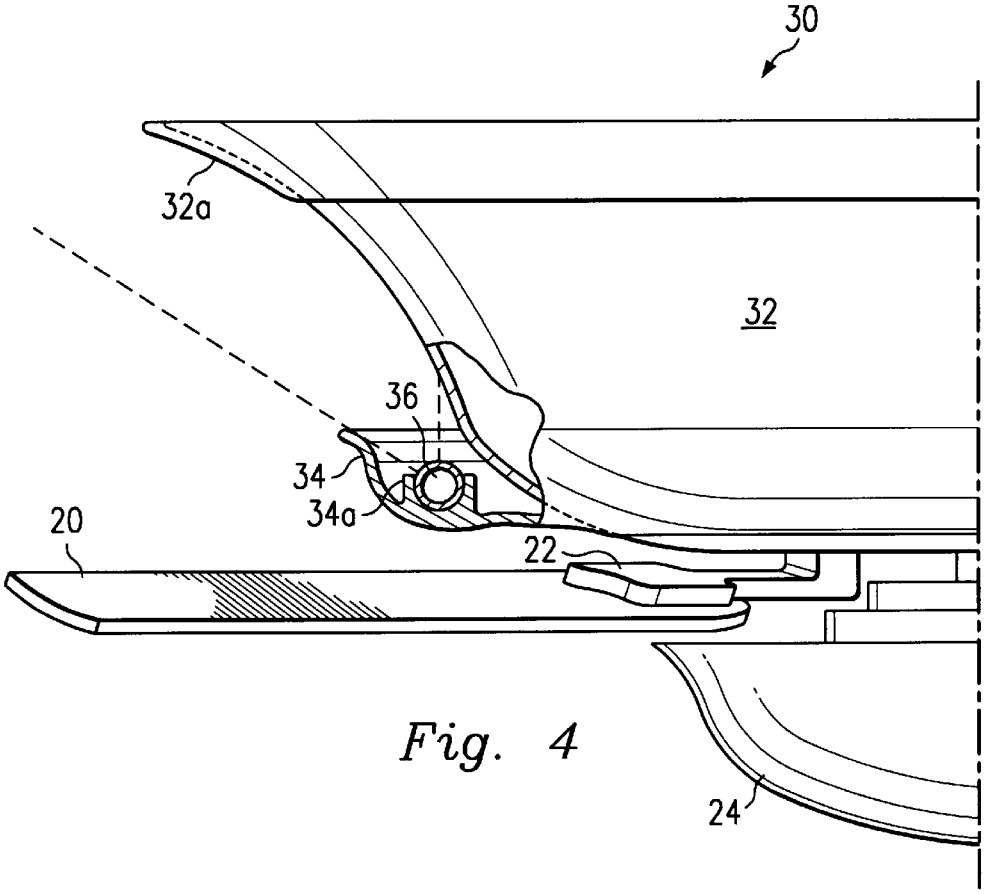
FIG. 4 is a cut-away side view of the assembly of FIG. 3.

Turning now to FIGS. 3 and 4, a ceiling fan assembly, generally designated 30, is shown, similar to the assembly 10 in FIG. 1, having a housing 32, a cover ring 34, and a tubular light source 36. The assembly 30 is similar to the assembly 10 except that the covers 16 and the bulbs 26 are replaced by the cover ring 34 and the tubular light source 36, respectively, with the tubular light source 36 mounted within the cover ring 34 by means of a channel 34*a*. As discussed above, light from the tubular light source 36 radiates equally in all directions. Accordingly, light travels upwards toward the housing 32 and downward toward the cover ring 34. The cover ring 34 blocks the light traveling downward toward the rotational plane of the fan blades 20. Such prevention and elimination of direct illumination generated by the tubular light source 36 from traveling through the rotational plane of the fan blades 20 eliminates strobe effects. Light also travels in an upward direction toward the housing 32. The tubular light source 36 is located in close proximity to an exterior surface of the housing 32. As illumination from the tubular light source 36 comes into contact with the housing 32, the housing 32 disperses the light about the housing 32. This creates the aesthetic effect of illuminating the entire housing 32. Furthermore, dispersion of the illumination prevents direct downward reflections and thereby prevents illumination from the tubular light source 36 from intersecting the rotational plane of the fan blades 20. Thus, strobe effects are further eliminated by the housing 32 due to dispersion of the light.

As shown in FIG. 4, the housing 32 includes an aesthetic annular ring 32*a* surrounding its uppermost portion. Elements such as the annular ring 32*a*, as well as more detailed sculpting and design elements, enhance the illumination of the housing 32 and can provide pleasing lighting effects without causing strobe effects.

Figure 5:
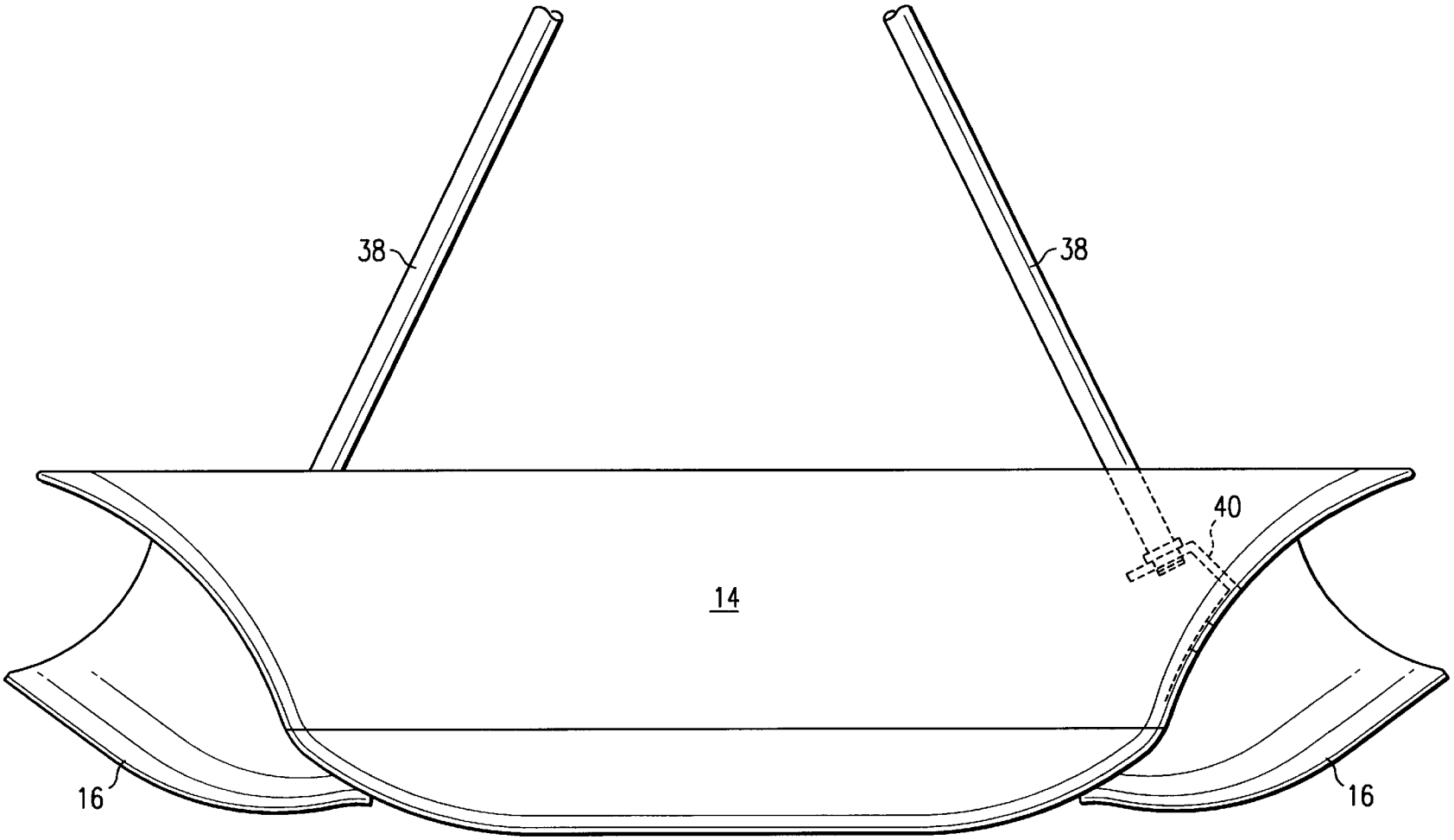
FIG. 5 illustrates another embodiment of the present invention wherein multiple stems are used to suspend the ceiling fan.

FIG. 5 illustrates an alternative embodiment of the present invention, wherein the stem 12 can be replaced by two or more stems 38 secured to mounting brackets 40. Each of the mounting brackets 40 is secured to the interior of the housing 14. The covers 16 can also be secured to the mounting brackets 40 through the housing 14.

Although illustrative embodiments of the invention have been shown and described, other modifications, changes, and substitutions are intended in the foregoing disclosure. For example, even though only two light sources are disclosed, any number of other light sources can be used without deviation from the scope of the invention. Accordingly, it is appropriate that the appended claims be construed broadly and in a manner consistent with the scope of the invention.

What is claimed is:

1. A ceiling fan for circulating air within a room, the fan comprising:

a housing for containing a motor assembly which produces rotational motion;

a plurality of blades attached to the motor assembly and extending radially outward from beneath the housing for rotating within a plane of rotation for circulating air;

means disposed about the exterior of the housing for producing aesthetic lighting effects by directly illuminating the exterior of the housing; and means coupled to the housing and disposed between the producing means and the plurality of blades for preventing direct illumination from the producing means toward the plane of rotation of the plurality of blades.

2. The ceiling fan of claim 1 wherein the producing means comprises a plurality of incandescent light bulbs secured along a circumference of the housing.

3. The ceiling fan of claim 2 wherein the plurality of incandescent light bulbs are evenly spaced.

4. The ceiling fan of claim 3 further comprising a plurality of stems secured to the housing for suspending the ceiling fan within the room.

5. The ceiling fan of claim 4 wherein the number of stems equals the number of incandescent light bulbs disposed about the housing such that each stem is secured to an interior of the housing at a corresponding location of each of the plurality of incandescent light bulbs thereby allowing the stem to be attached to the preventing means.

6. The ceiling fan of claim 5 wherein the preventing means comprises a plurality of covers distributed about the housing such that one of the plurality of covers is secured to one of the plurality of stems.

7. The ceiling fan of claim 2 wherein the preventing means comprises a plurality of covers coupled to the housing adjacent each of the incandescent light bulbs.

8. The ceiling fan of claim 1 wherein the producing means is a tubular light source secured to the preventing means.

9. The ceiling fan of claim 8 further comprising a plurality of stems secured to the housing for suspending the ceiling fan within the room.

10. The ceiling fan of claim 8 wherein the preventing means is secured to the housing at the circumference and extends circumferentially about the housing in correspondence with the tubular light source.

11. The ceiling fan of claim 10 wherein the preventing means comprises a cover ring disposed about a perimeter of the housing.

12. The ceiling fan of claim 8 wherein the preventing means comprises a cover ring secured to a perimeter of the housing.

13. The ceiling fan of claim 1 wherein the housing contains design elements attached thereto for reflecting light.

14. An apparatus for a ceiling fan having a motor assembly and a plurality of fan blades attached thereto, the apparatus comprising:

a housing having an interior capable of containing the motor assembly;

means disposed about the exterior of the housing for producing aesthetic lighting effects by directly illuminating the exterior of the housing; and means coupled to the housing for preventing projection of direct illumination from the producing means toward the plurality of fan blades.

15. The apparatus of claim 14 wherein the housing is bowl shaped such that an upper end of the housing has a circumference larger that a circumference of a lower end of the housing.

16. The apparatus of claim 15 wherein the producing means comprises a plurality of incandescent light bulbs distributed about the housing.

17. The apparatus of claim 16 wherein the plurality of incandescent light bulbs are evenly spaced along a circumference of the housing.

18. The apparatus of claim 17 wherein the preventing means comprises a plurality of covers coupled to the housing adjacent each of the incandescent light bulbs.

19. The apparatus of claim 14 wherein the producing means is a tubular light source disposed about the housing.

20. The apparatus of claim 19 wherein the preventing means comprises a cover ring secured to the perimeter of the housing for supporting the tubular light source.

21. A ceiling fan for circulating air within a room, the fan comprising:

a housing for containing a motor assembly which produces rotational motion;

a plurality of blades attached to the motor assembly and extending radially outward from beneath the housing for rotating within a plane of rotation for circulating air;

a plurality of incandescent light bulbs evenly spaced about and secured along a circumference of the exterior of the housing for illuminating the room;

a plurality of stems secured to the housing for suspending the ceiling fan within the room, wherein the number of stems equals the number of incandescent light bulbs disposed about the housing such that each stem is secured to an interior of the housing at a corresponding location of each of the plurality of incandescent light bulbs thereby allowing the stem to be attached to the preventing means; and means coupled to the housing and disposed between the light source and the plurality of blades for preventing direct illumination from the plurality of incandescent bulbs toward the plane of rotation of the plurality of blades, wherein the preventing means comprises a plurality of covers distributed about the housing such that one of the plurality of covers is secured to one of the plurality of stems.

22. An apparatus for a ceiling fan having a motor assembly and a plurality of fan blades attached thereto, the apparatus comprising:

a housing having an interior capable of containing the motor assembly, wherein the housing is bowl shaped such that an upper end of the housing has a circumference larger that a circumference of a lower end of the housing;

a light source disposed about the exterior of the housing; and means coupled to the housing for preventing projection of direct illumination from the light source toward the plurality of fan blades.

23. The apparatus of claim 22 wherein the light source comprises a plurality of incandescent light bulbs distributed about the housing.

24. The apparatus of claim 23 wherein the plurality of incandescent light bulbs are evenly spaced along a circumference of the housing.

25. The apparatus of claim 24 wherein the preventing means comprises a plurality of covers coupled to the housing adjacent each of the incandescent light bulbs.

26. The apparatus of claim 22 wherein the light source is a tubular light source disposed about the housing.

27. The apparatus of claim 26 wherein the preventing means comprises a cover ring secured to the perimeter of the housing for supporting the tubular light source.

28. A ceiling fan for circulating air within a room, the fan comprising:

a housing for containing a motor assembly which produces rotational motion;

a plurality of blades attached to the motor assembly and extending radially outward from beneath the housing for rotating within a plane of rotation for circulating air;

a plurality of light sources disposed about the exterior of the housing; and a plurality of covers integrally connected to the housing for preventing direct illumination from the plurality of light sources toward the plane of rotation of the plurality of blades, wherein one each of the plurality of covers is connected to the housing adjacent one each of the plurality of light sources.

* * * * *